US005208592A

United States Patent [19]

Johnson, Jr.

[11] Patent Number: 5,208,592

[45] Date of Patent: May 4, 1993

[54] DATA LOADING AND DISTRIBUTING PROCESS AND APPARATUS FOR CONTROL OF A PATTERNING PROCESS

[75] Inventor: Harold L. Johnson, Jr., Pauline, S.C.

[73] Assignee: Milliken Research Corporation, Spartanburg, S.C.

[21] Appl. No.: 592,034

[22] Filed: Oct. 2, 1990

Related U.S. Application Data

[62] Division of Ser. No. 327,843, Mar. 23, 1989, Pat. No. 4,984,169.

[51] Int. Cl.[5] ..... H03M 7/00; H03K 21/10; H03K 5/04

[52] U.S. Cl. ..... 341/63; 377/39; 328/58

[58] Field of Search ..... 341/63, 52, 95; 377/39, 377/20; 68/205 R; 328/58

[56] References Cited

U.S. PATENT DOCUMENTS

| | | | |
|---|---|---|---|
| 3,737,780 | 6/1973 | Tomozawa | 341/63 X |
| 3,824,378 | 7/1974 | Johnson et al. | 377/39 |
| 3,836,858 | 9/1974 | Kitano | 377/39 X |
| 3,894,413 | 7/1975 | Johnson | 68/205 R |
| 4,033,154 | 7/1977 | Johnson | 68/205 R |
| 4,116,626 | 9/1978 | Varner | 8/149 |
| 4,170,883 | 10/1979 | Varner | 68/205 R |
| 4,545,086 | 10/1985 | Varner | 8/151 |
| 4,608,706 | 8/1986 | Chang et al. | 377/39 |
| 4,636,967 | 1/1987 | Bhatt et al. | 377/39 X |
| 4,712,224 | 12/1987 | Nelson | 377/39 X |
| 4,939,755 | 7/1990 | Akita et al. | 377/39 |
| 4,998,224 | 1/1991 | Narahara et al. | 377/39 |

*Primary Examiner*—Sharon D. Logan
*Attorney, Agent, or Firm*—Kevin M. Kercher; H. William Petry

[57] ABSTRACT

A method and apparatus for real time processing of digitally encoded pattern information suitable for distributing such information to a large number of individual pattern applicators which are grouped into a number of successive arrays. When applied to a patterning process involving the selective application of dye streams to a moving substrate, the disclosed real time processing includes transforming pattern data to corresponding dye contact times, resequencing the transformed data to compensate for physical spacing between arrays, and converting the resequenced data to logical dye stream contact commands to be sent to the individual applicators.

1 Claim, 12 Drawing Sheets

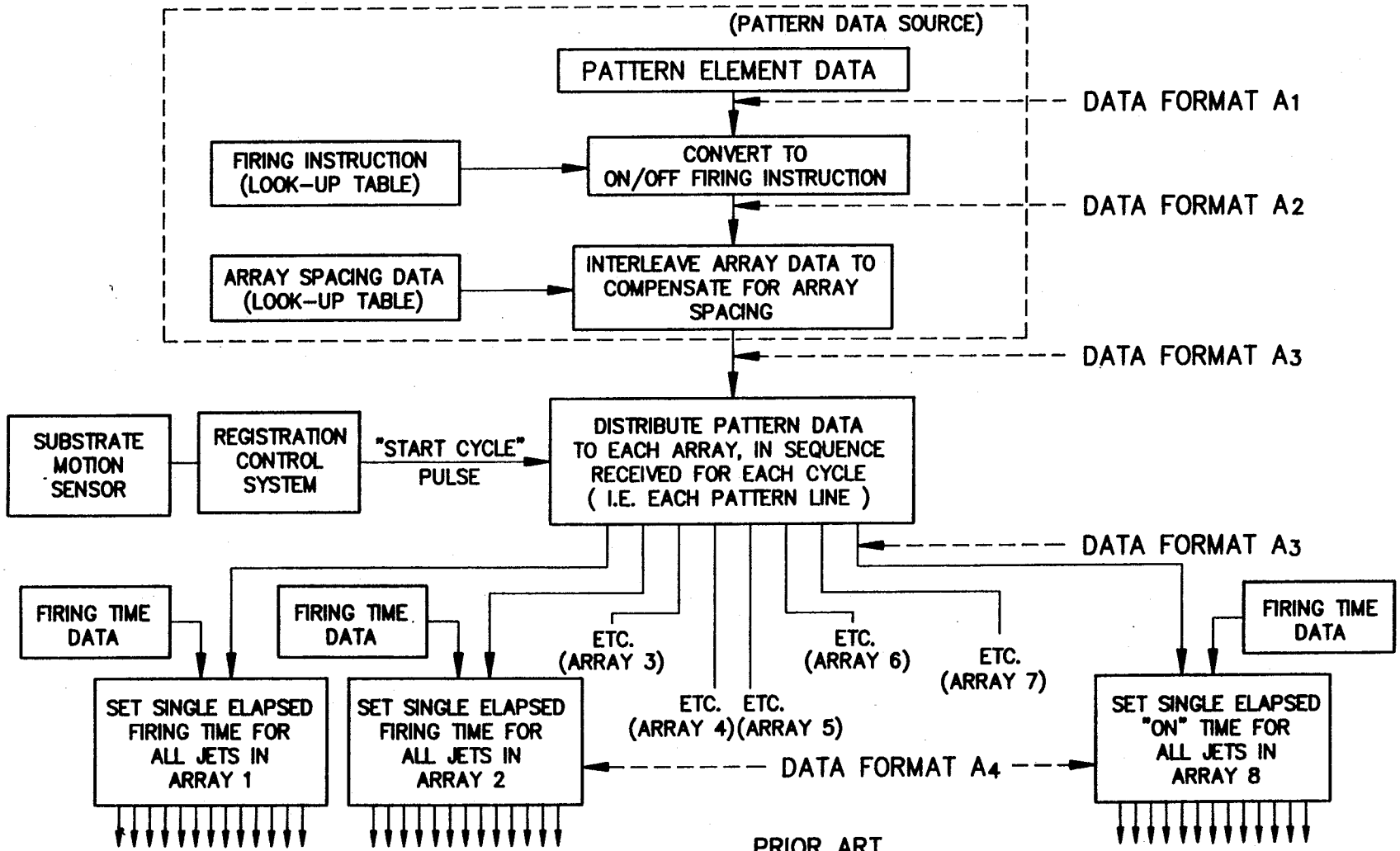
PRIOR ART
*FIG. —6—*

DATA LOADING AND DISTRIBUTING PROCESS AND APPARATUS FOR CONTROL OF A PATTERNING PROCESS

This is a division of application Ser. No. 07/327,843, filed Mar. 23, 1989, now U.S. Pat. No. 4,984,169.

This invention relates to an electronic data loading and distribution system which may be used to control the selective application of dyes or other marking materials to a moving substrate in accordance with digitally encoded pattern data. In particular, this invention, in one embodiment, may be used in conjunction with a textile dyeing apparatus comprising multiple arrays of individually addressable dye jets, which arrays are positioned across and along the path of a moving substrate. By use of the invention herein, a large quantity of digitally encoded pattern data may be transformed, at a relatively high data rate and in real time, into digitally encoded individual instructions which may be sent to each dye jet comprising the respective arrays.

It is believed the invention herein may be used in a variety of situations where a large quantity of digitally encoded data must be sorted and routed rapidly to a large number of individual locations. One such application, involves the pattern-wise application of dyestuffs to textile be sorted and routed to a large number of individual dye jets. Dyeing systems of this latter type are generally described in greater detail in, for example, commonly assigned U.S. Pat. Nos. 3,894,413, 3,942,343, 3,969,779, 4,033,154, 4,034,584, 4,116,626, 4,309,881, 4,434,632, and 4,584,854.

In these systems, several arrays comprised of individually controllable and addressable dye jets are arranged in spaced, parallel relation generally above and across the path of a moving web of substrate. For a given desired pattern, each array is associated with a single color of dye. A stream of dye, directed at the moving substrate, continuously flows from each dye jet. Positioned along the path of each dye stream is an individual, transversely directed stream of air capable of intersecting and diverting the respective individual dye stream into a catch basin. Each such diverting air stream is associated with a valve which is capable of interrupting the flow of air in accordance with externally supplied pattern data. Accordingly, each of the diverting streams of air may be interrupted in accordance with such pattern data and thereby initiate the flow of dye onto the substrate from the various respective dye jet locations along the length of the array. For purposes of discussion, referring to a dye stream or dye jet as being "on" or "off" in the context of the patterning methods and apparatus described in detail herein merely refers, respectively, to whether the continuously flowing dye stream from the dye jet is being allowed to strike, or is being prevented from striking, the substrate.

In the dyeing apparatus contemplated above, up to eight arrays, each assigned to a different color dye or other patterning agent, are sometimes necessary to generate a pattern having the desired color variety and blending Additionally, each array may have hundreds or thousands of individually controllable dye jets in order to generate a pattern having the desired complexity and lateral pattern resolution. Precise pattern resolution along the direction of substrate travel depends primarily upon the speed and precision with which the individual dye streams can be made to strike or not strike the continuously moving substrate.

In connection with such systems, it has been found necessary to develop electronic control systems for the purpose of transforming the pattern data into air valve actuating commands and distributing such commands to the appropriate air valves at the appropriate time. A principal object in making such data transformation involves delaying, by successive time periods equal to the travel time of the substrate from array to adjacent array, the patterning instructions concerning a given localized area of the moving substrate sent to the respective adjacent arrays. Such electronic control systems are described, for example, in commonly assigned U.S. Pat. Nos. 3,894,413, 3,969,779, 4,033,154, and 4,116,626. Such control systems, however, have relied heavily upon the digital processing capabilities of a digital computer to convert, by means of software instructions and computer-intensive calculations, the pattern data into individually addressed dye jet instructions. Such conversions have necessarily been done, at least in part, in an "off line" manner in advance of the actual pattering operation. For dyeing apparatus having a large number of dye jets per array and multiple arrays, the real time data processing capabilities necessary in patterning substrates at acceptable levels of pattern resolution and at commercially practical speeds have required an impractically high level of computer sophistication.

In the control system described in above-mentioned U.S. Pat. No. 4,033,154, apparatus is described for demultiplexing and distributing a digital data stream to a plurality of arrays, each array being comprised of multiple dye jets However, this control system is limiting in that the period of time during which any of the dye streams in a given array may be allowed to strike the substrate must be the same for all dye streams in the array, i.e., this control system is incapable of allowing one dye stream to dispense dye onto the substrate for a different period of time than another dye stream in the same array. Therefore, all dye streams in a given array which are programmed to dispense dye onto the substrate during a given patterning time increment must remain "on" for the same predetermined period of time along the length of the array. Because the arrays extend across the width of the substrate path as the substrate is moving under the arrays, this limitation is reflected in an inability to produce side-to-side shade variations simply by varying the quantity of dye applied to the substrate along the length of a given array.

An additional limitation of this prior art control system involves the precision with which the individual dye jets may be turned "on" or "off" within various predetermined brief periods of time. This results in a limitation in the degree of pattern detail, as well as in the flexibility of color shading, which is possible to produce on the substrate along the direction of movement of the substrate.

Related to this problem is a limitation of prior art control systems regarding the maximum number of colors or shades which may be programmed and patterned with a given array or set of arrays (i.e., with a given set of colors with which to form a palette). This limitation is a consequence of the difficulty in generating and transferring the volume of data necessary to characterize each pattern element comprising a pattern line at the maximum pattern resolution desired. The term "pattern element" as used herein is intended to be analogous to the term "pixel", as that term is used in the field of electronic imaging, i.e., the smallest portion of the patterned area which is individually controllable. The term "pattern line" as used herein is intended to describe a continuous line of single pattern elements extending across the substrate, parallel to the patterning arrays. Such pattern line has a thickness, measured in the direction of substrate travel, equal to the maximum permitted amount of substrate travel under the patterning arrays between array pattern data updates.

By use of the novel electronic control system described herein, as applied to the textile dyeing machines generally described in the U.S. patents noted above, textile products of dramatically improved detail as well as subtlety of color or shade may be produced. As discussed above, this electronic control system is believed to be applicable to a variety of marking or patterning systems where large quantities of pattern data must be allocated and delivered to a large number of individually controllable imaging locations, and is not limited to use in connection with the patterning devices disclosed herein.

Essentially, the control system of the instant invention processes pattern data through the novel use of specific electronic circuitry in the form of integrated circuits, rather than through the use of software-directed computational procedures, as is done in the prior art control systems noted above. In a preferred embodiment, the control system of the present invention may be summarized as follows.

Pattern data is accepted in the form of a series of eight bit units which uniquely identify, for each pattern element or pixel, a pattern design element to be associated with that pattern element or pixel. The number of different pattern design elements is equal to the number of distinct areas of the pattern which may be assigned a separate color.

The process of sequencing the individual pattern line data to accommodate substrate travel time between adjacent arrays is performed through the use of array-specific Random Access Memories (RAMs), which are preferably of the static type. All pattern data for a specific array is loaded into a RAM individually associated with that array. The pattern data is in the form of a series of bytes, each byte specifying a desired firing time for a single applicator or jet comprising the array. The loading process is a coordinated one, with all jet firing time data being loaded into the respective RAMs at the same time and in the same relative order, i.e., all firing times corresponding to the first line of the pattern for all jets in each array is loaded in the appropriate RAM first, followed by all data corresponding to the second pattern line, etc. Each RAM is read using reading address offsets which effectively delay the reading of the data a sufficient amount of time to allow a specific area of the substrate to "catch up" to the corresponding pattern data for that specific area which will be sent to the next array along the substrate path.

At this time, the pattern data, in the form of a series of individual firing times expressed in byte form, is preferably transferred into a sequence of individual binary digit ("bit") groups. Each group in the sequence represents the value of its corresponding respective firing time by the relative number of binary digits of a predetermined logic value (e.g., logical "one" ="fire") which are sequentially "stacked" within each group. This transformation allows the firing times, expressed in byte form, to be expressed as a continuing sequence of individual firing commands (i.e., single bits) which may be recognized by the applicators The data from each RAM, having been sequenced to accommodate the substrate travel time between the arrays, is loaded into a collection of First-In First-Out Memories (FIFOs). Each array is associated with an individual set of FIFOs. Each FIFO repeatedly sends its contents, one byte at a time and strictly in the order in which the bytes were originally loaded, to a comparator. The value of the byte, representing a desired elapsed firing time of a single jet along the array, is compared with a clock value which has been initialized to provide a value representing the smallest increment of time for which control of any jet is desired As a result of the comparison, a firing command in the form of a logical "one" or logical "zero", which signifies that the jet is to "fire" or "not fire", respectively, is generated and, in a preferred embodiment, is forwarded to a shift register associated with the array, as well as to a detector. After all bytes (representing all jet locations along that array) have been sent and compared, the contents of the shift register are forwarded, in parallel, to the air valve assemblies along the array by way of a latch associated with the shift register. Thereafter, the counter value is incremented, the same contents of the FIFO are compared with the new counter value, and the contents of the shift register are again forwarded, in a parallel format and via a latch, to the air valve assemblies in the array.

At some counter value, all elapsed firing times read from the FIFOs will be less than or equal to that value of the counter. When this condition exists at every array, fresh data, representing a new pattern line, is forwarded from the RAM in response to a transducer pulse indicating the substrate has moved an amount equivalent to one pattern line. This fresh data is loaded into the FIFOs and a new series of iterative comparisons is initiated, using a re-initialized counter. This process is repeated until all pattern lines have been processed. If the pattern is to be repeated, the RAM re-initiates the above procedure by sending the first pattern line to the appropriate FIFO's.

Details of the control system herein, as well as additional advantages and distinguishing features, will be better understood with reference to the following Figures, in which:

FIG. 6 is a block diagram disclosing, in overview, an electronic control system of the prior art;

Figure 7:
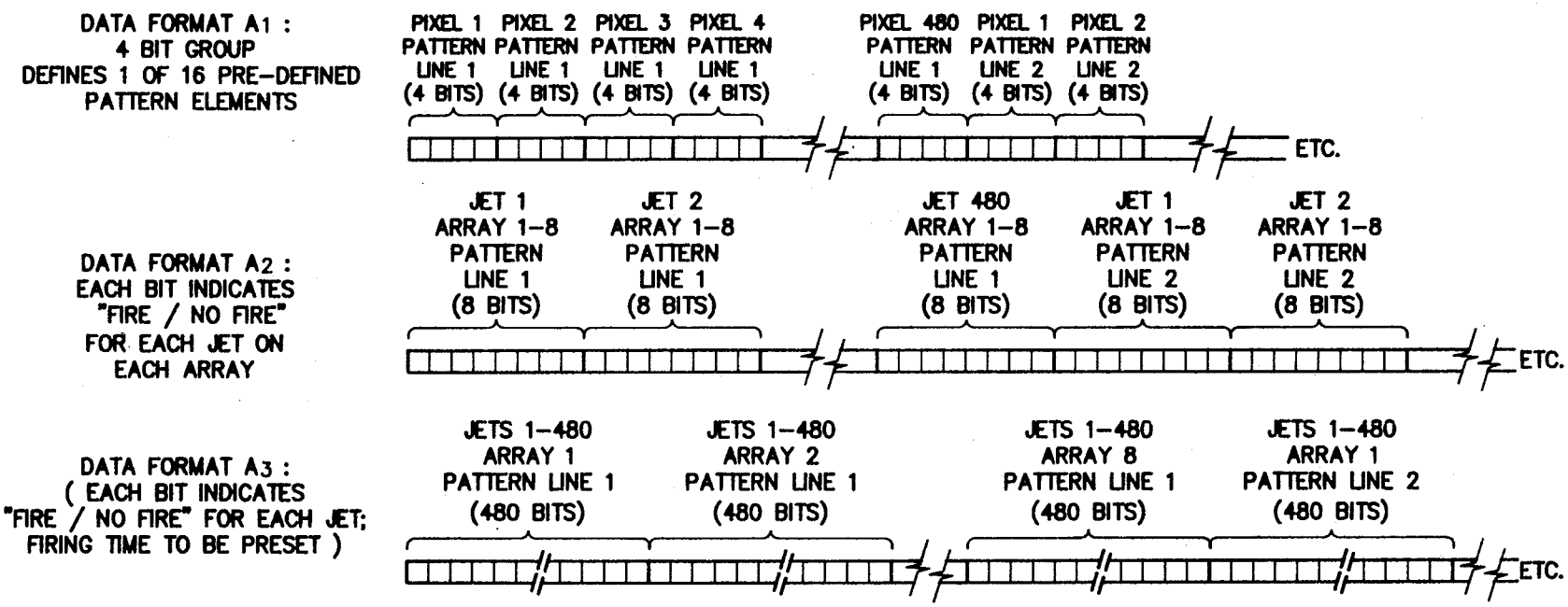
PRIOR ART FIG. -7-
Figure 8:
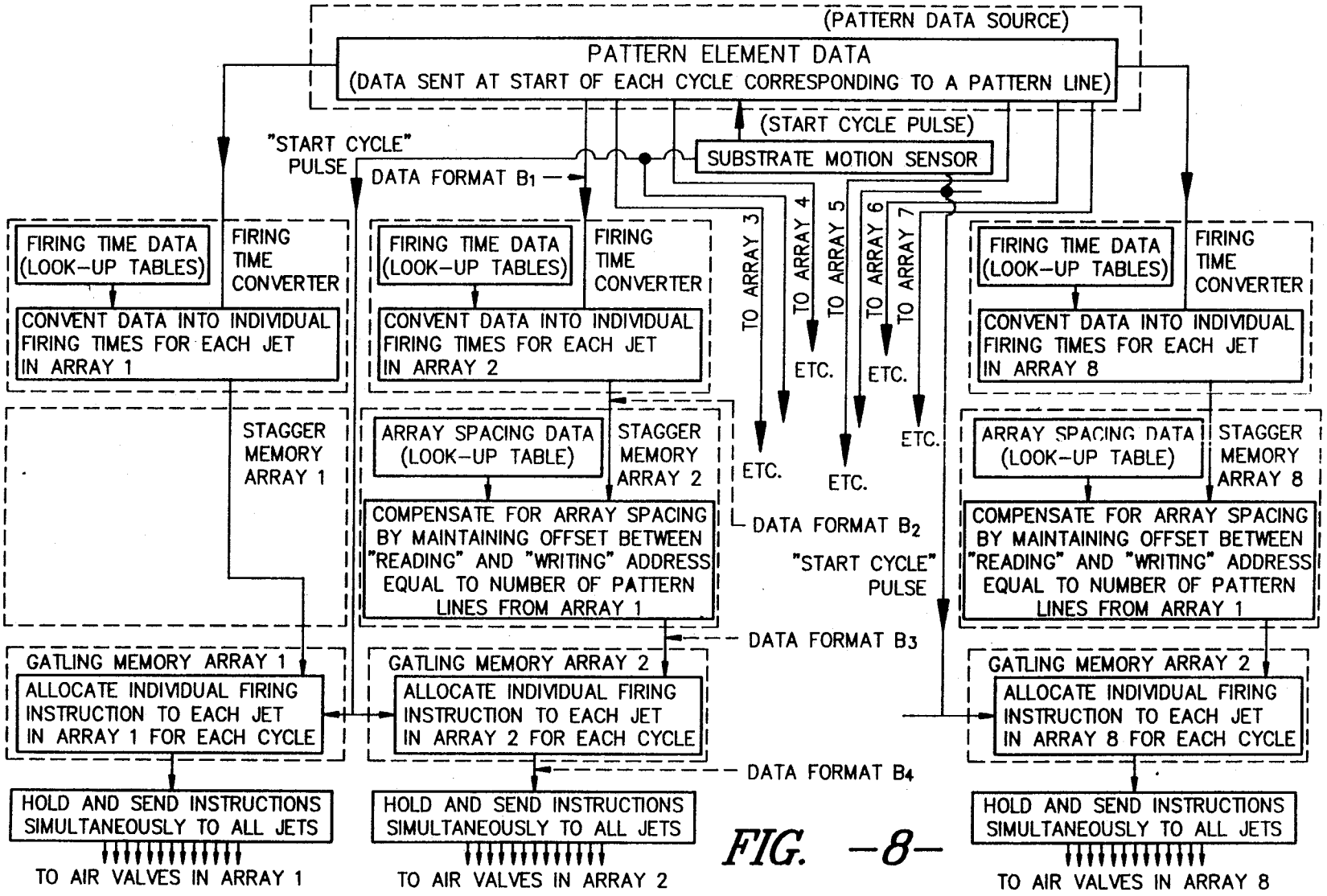
Figure 9A:
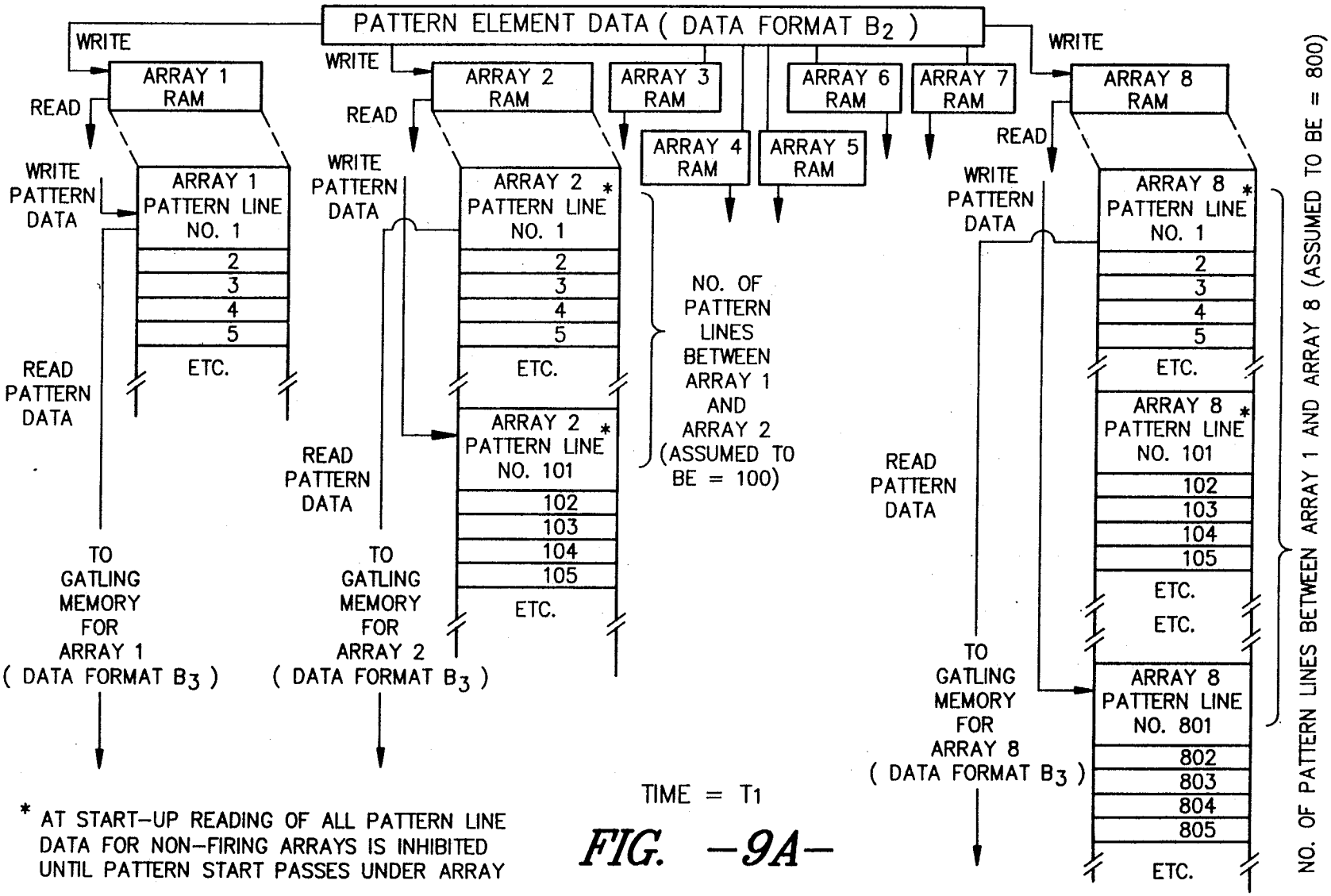
Figure 9B:
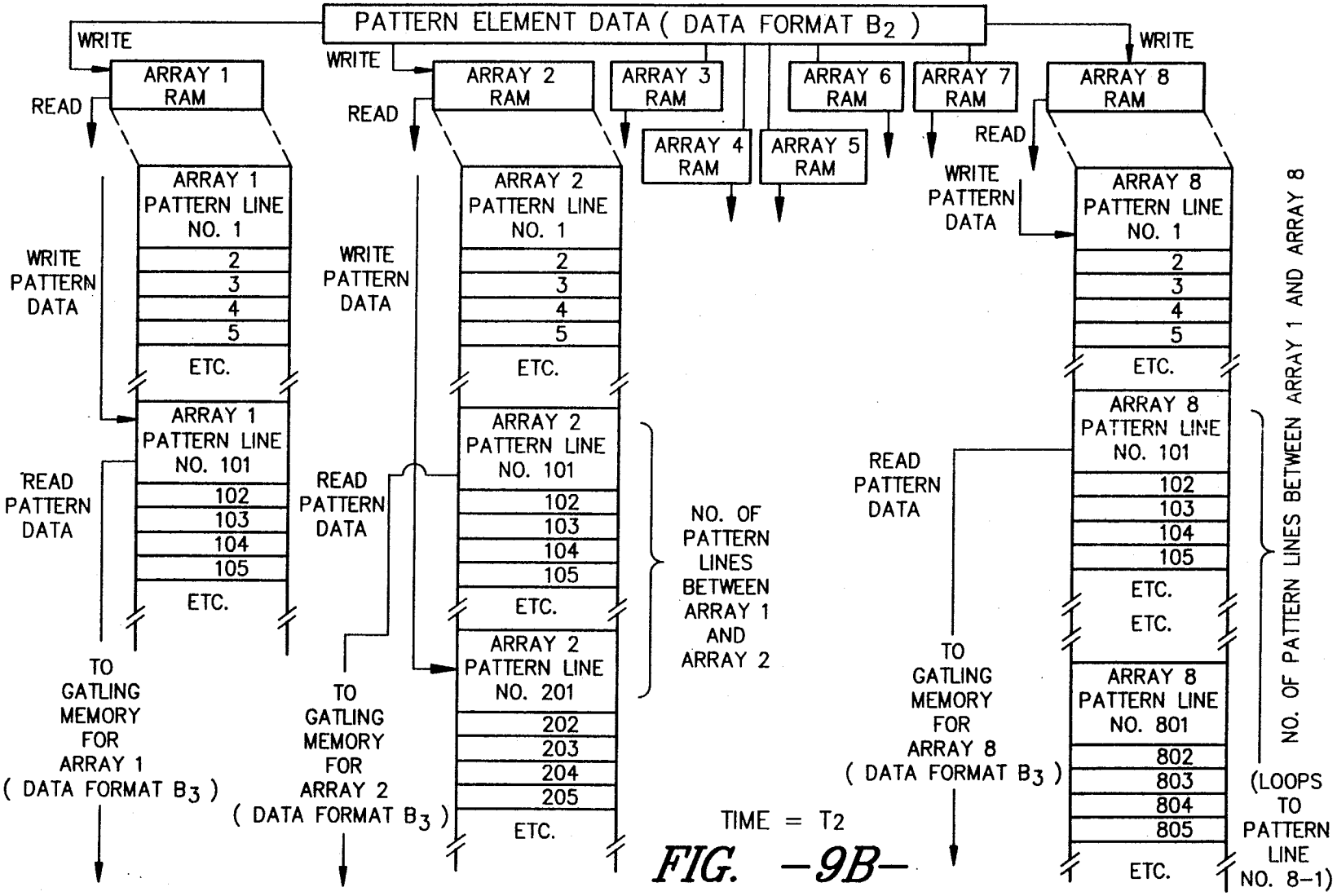
Figure 10:
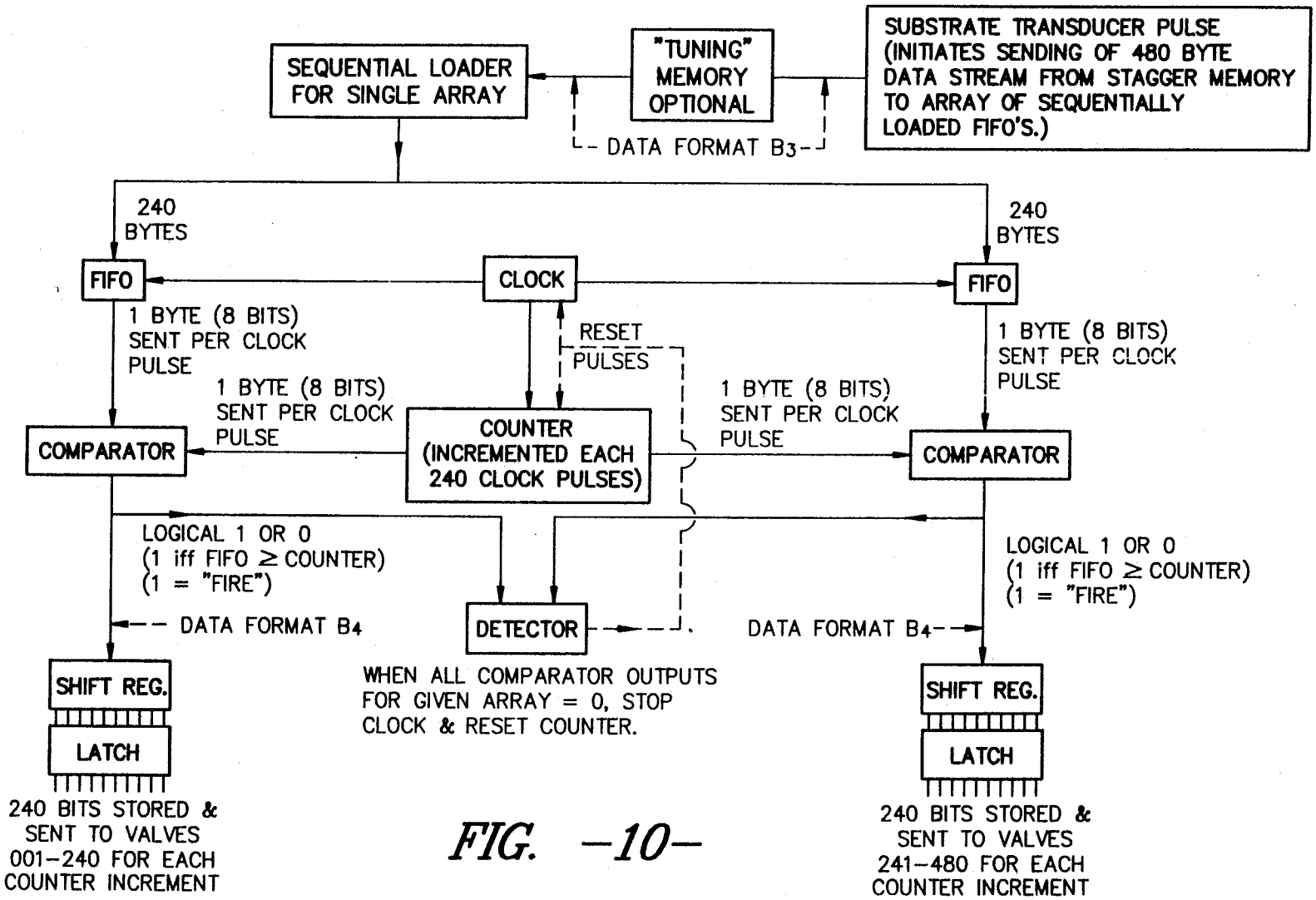
Figure 11:
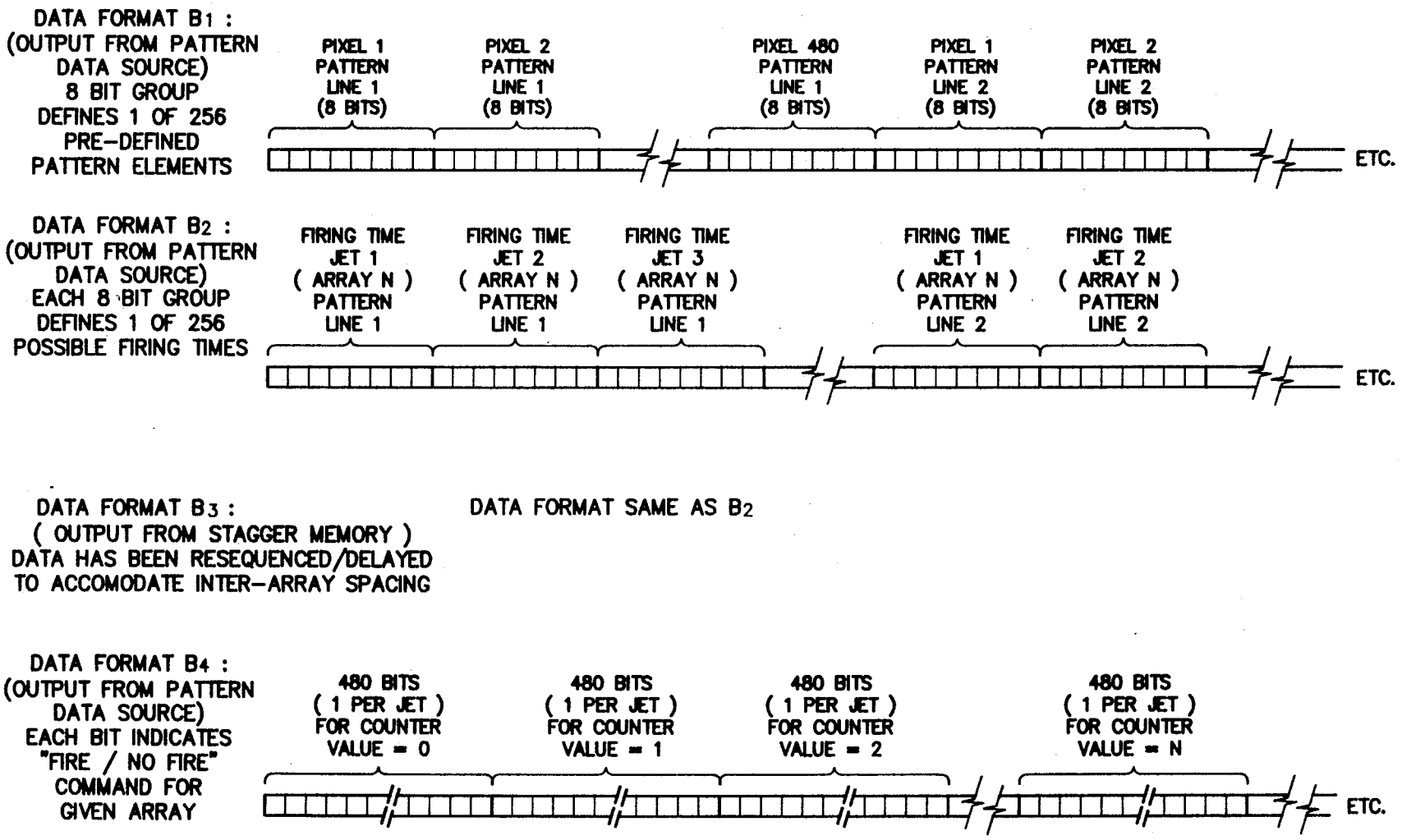

FIG. 7 schematically depicts the format of the pattern data at the previously known data processing stages indicated in FIG. 6;

FIG. 8 is a block diagram disclosing, in overview, the novel electronic control system disclosed herein;

FIGS. 9A and 9B are diagrammatic representations of the "stagger" memory disclosed in FIG. 8. FIG. 9A depicts a memory state at a time $T_1$; FIG. 9B depicts a memory state at time $T_2$, exactly one hundred pattern lines later;

FIG. 10 is a block diagram describing the "gatling" memory described in FIG. 8;

FIG. 11 schematically depicts the format of the pattern data at various data processing stages of the present invention as indicated in FIGS. 8 through 10.

Figure 12:
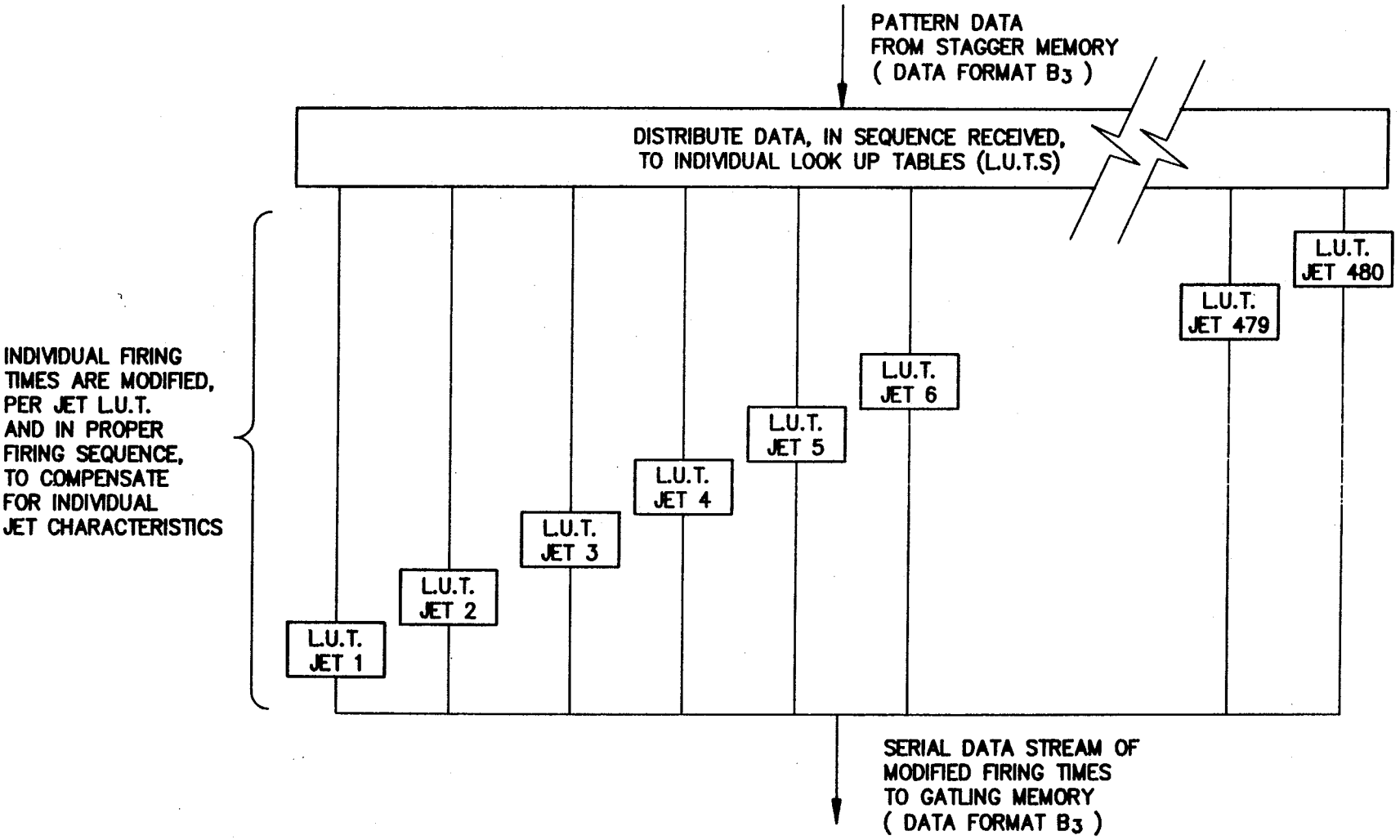

FIG. 12 is a diagram showing an optional "jet tuning" function which may be associated with each array, as described herein.

For purposes of discussion, the electronic control system of the instant invention will be described in conjunction with the metered jet patterning apparatus discussed above and depicted in the Figures, to which this control system is particularly well suited It should be understood, however, that the electronic control system of the instant invention may be used, perhaps with obvious modifications, in other devices where similar quantities of digitized data must be rapidly distributed to a large number of individual elements.

Figure 1:
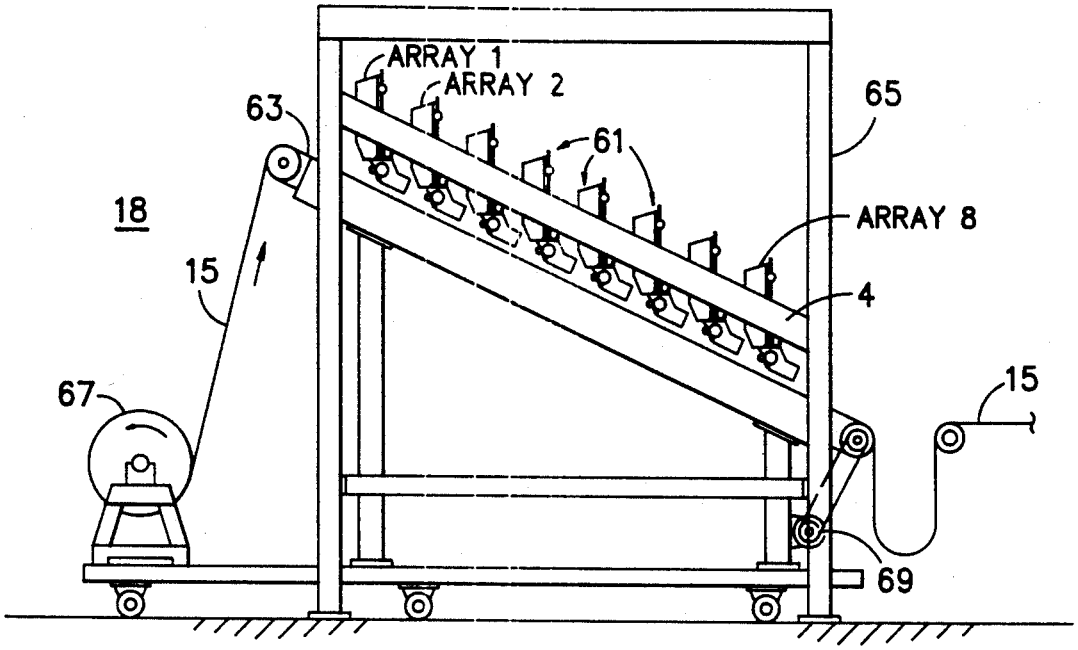
FIG. 1 is a diagrammatic side elevation view of a metered jet dyeing apparatus to which the present invention is particularly well adapted.

FIG. 1 depicts, in a side elevation view, a patterning machine comprised of a set of eight individual arrays 26 positioned within frame Each array 26 is comprised of a plurality of dye jets, perhaps several hundred in number, arranged in spaced alignment along the length of the array, which array extends across the width of substrate 12 Substrate 12, for example, a textile fabric, is supplied from roll 10 and is transported through frame 22 and thereby under each array 26 by conveyor 14 driven by a motor indicated generally at 16. After being transported under arrays 26, substrate 12 may be passed through other dyeing-related process steps such as drying, fixing, etc.

Figure 2:
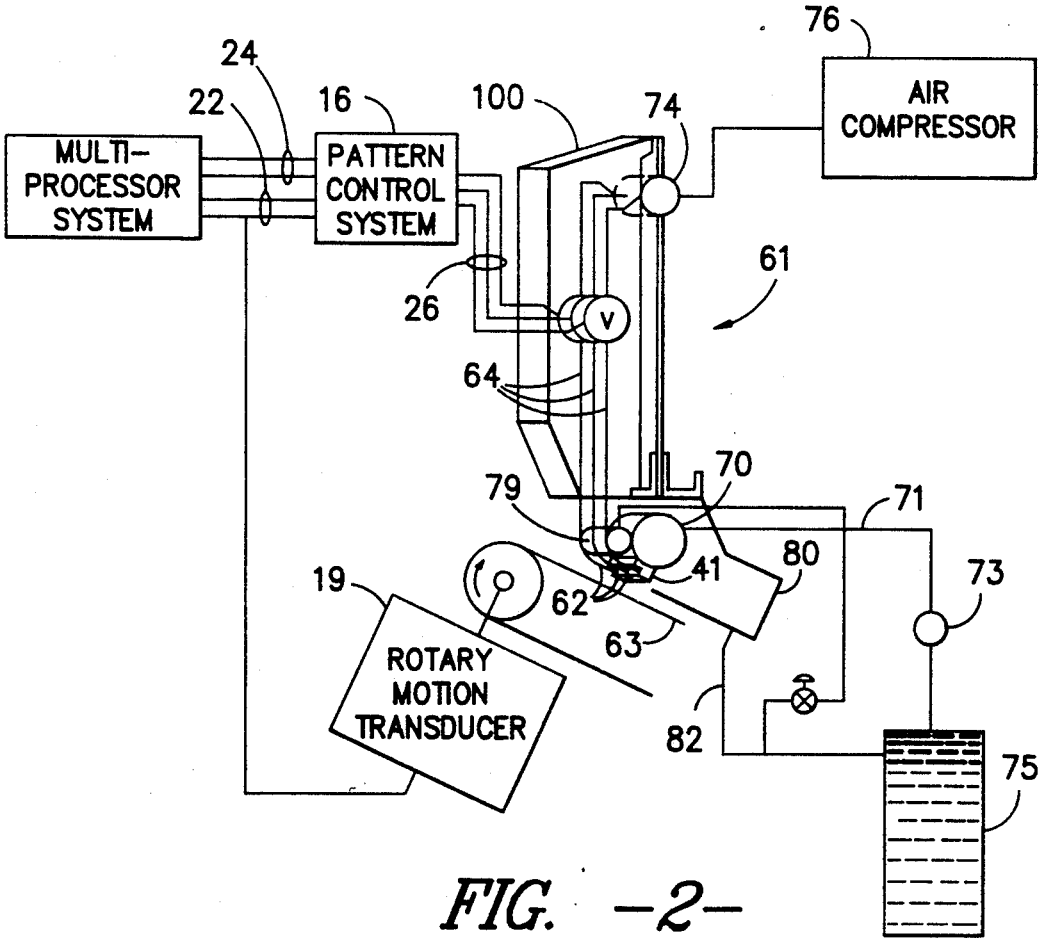
FIG. 2 is a schematic side elevation view of the apparatus of FIG. 1, showing only a single dye jet array and its operative connection to a liquid dye supply system, as well as several electronic subsystems associated with the apparatus.
Figure 3:
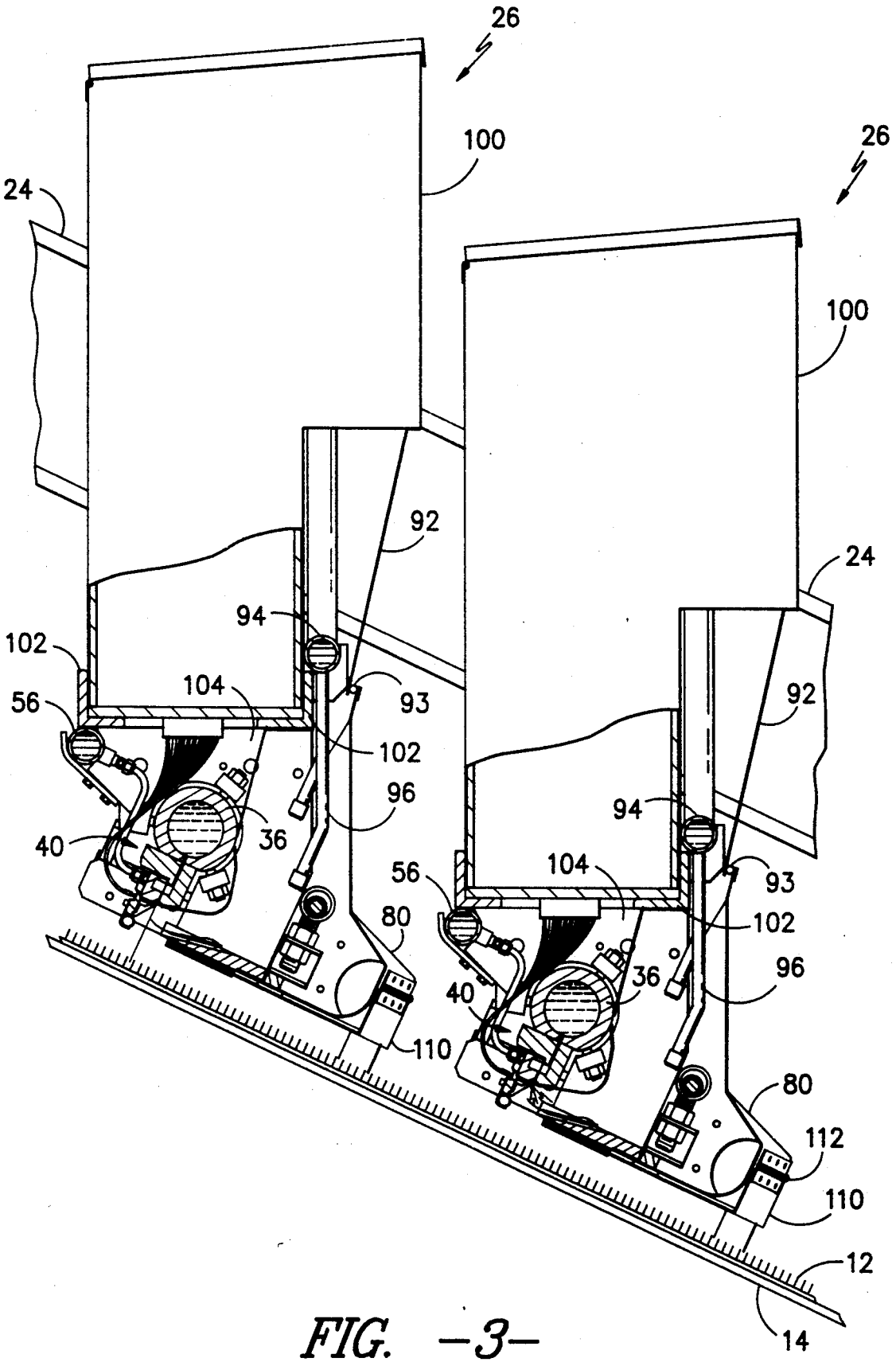
FIG. 3 is a diagrammatic side view of two of the arrays depicted in FIG. 1, in which the left-most array is shown with a liquid dye stream being applied to the substrate, and the right-most array is shown with a liquid dye stream being deflected into a catch basin.

FIG. 2 depicts, in schematic form, a side elevation of one array 26 comprising the machine of FIG. 1. For each such array, a separate dye reservoir tank 30 supplies liquid dye under pressure, by means of pump 32 and dye supply conduit means 34, to a primary dye manifold assembly 36 of the array. Primary manifold assembly 36 communicates with and supplies dye to dye sub-manifold assembly 40 (discussed in greater detail below and shown in greater detail in FIGS. 3 through 5A) at suitable locations along their respective lengths. Both manifold assembly 36 and sub-manifold assembly 40 extend across the width of conveyor 14 on which the substrate to be dyed is transported. Sub-manifold assembly 40 is provided with a plurality of spaced, generally downwardly directed dye passage outlets 52 (shown in FIG. 5A) positioned across the width of conveyor 14 which produce a plurality of parallel dye streams which are directed onto the substrate surface to be patterned.

Positioned in alignment with and approximately perpendicular to each dye passage outlet 52 in sub-manifold assembly 40 is the outlet of an air deflection tube 62. Each tube 62 communicates by way of an air deflection conduit 64 with an individual electro-pneumatic valve, illustrated collectively at "V", which valve selectively interrupts the flow of air to air tube 62 in accordance with pattern information supplied by pattern control device 20 Each valve is, in turn, connected by an air supply conduit to a pressurized air supply manifold 74 which is provided with pressurized air by air compressor 76. Each of the valves V, which may be, for example, of the electromagnetic solenoid type, are individually controlled by electrical signals from an electronic pattern control system 20 such as of the type described herein The outlets of deflection tubes 62 direct streams of air which are aligned with and impinge against the continuously flowing streams of dye flowing from downwardly directed dye passages within sub-manifold 40 and deflect such streams into a primary collection chamber or trough 80, from which liquid dye is removed, by means of a suitable dye collection conduit 82, to dye reservoir tank 30 for recirculation.

The pattern control system 20 for operating solenoid valves V may be comprised of various pattern control means, such as a computer with pattern information storage capabilities Desired pattern information from control system 20 is transmitted to the solenoid valves of each array at appropriate times in response to movement of the substrate under the arrays by conveyor 14, which movement is detected by suitable rotary motion sensor or transducer means 18 operatively associated with the conveyor 14 and connected to control system 20. The pattern control system 20 of the present invention will be discussed in detail herein below, in conjunction with reference to FIGS. 8 through 12.

FIGS. 3 through 5A depict end views, in partial or full section, of the arrays 26 of FIGS. 1 and 2. Individual support beams 102 for each array 26 extend across conveyor 14 and are attached at each end to diagonal frame members 24. Perpendicularly affixed at spaced locations along individual support beams 102 are plate-like mounting brackets 104, which provide support for primary dye manifold assembly 36 and associated apparatus, primary dye collection chamber 80 and associated apparatus, and the apparatus associated with the instant invention. In a preferred embodiment, valve boxes 100, supported by beams 102, may be used to house collectively the plurality of individual valves V, as well as the air manifold 74 (shown in FIG. 2) associated with each array.

Figure 4:
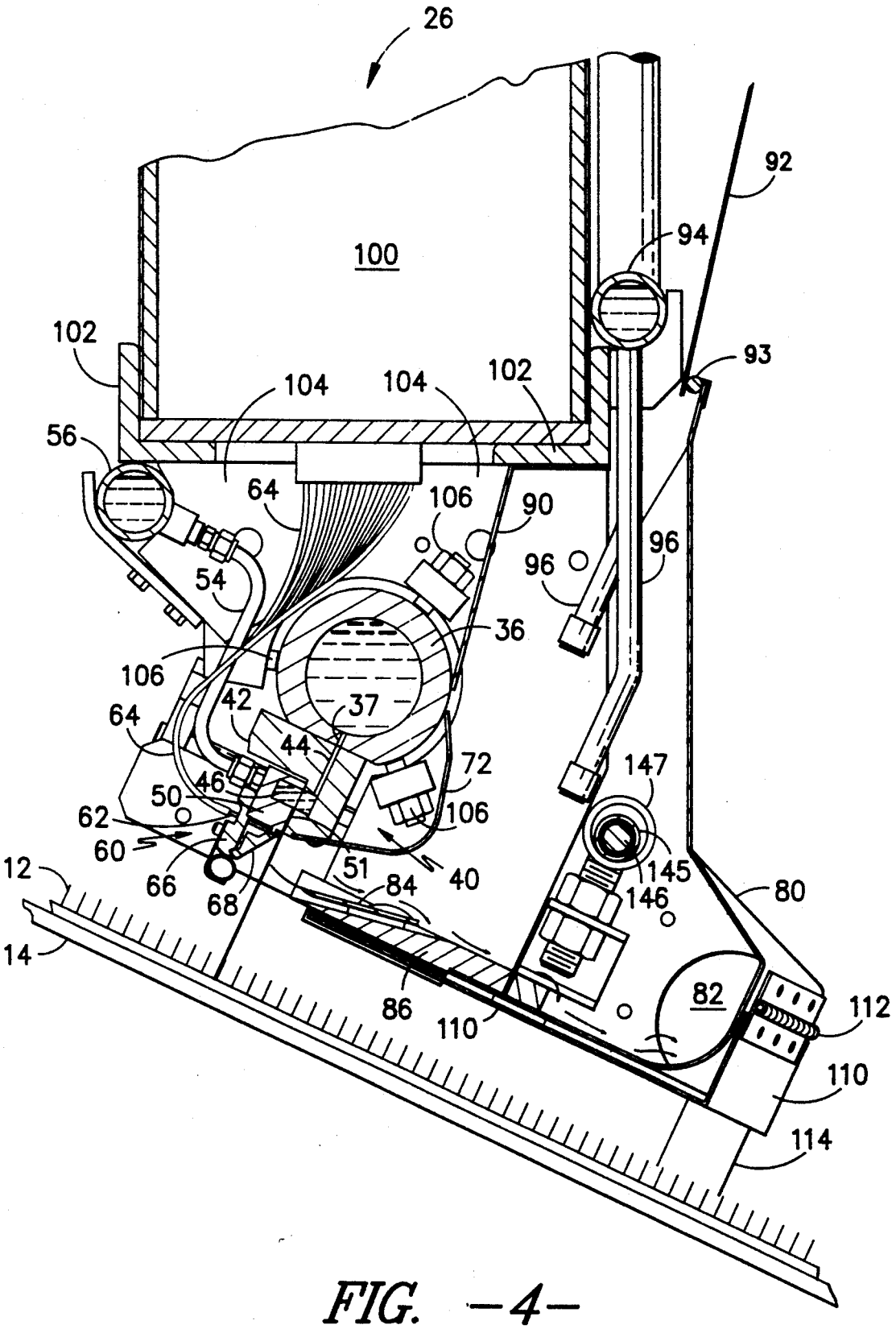
FIG. 4 is a more detailed view of the interior of the left most array of FIG. 3, showing the liquid dye stream striking the moving substrate.
Figure 5:
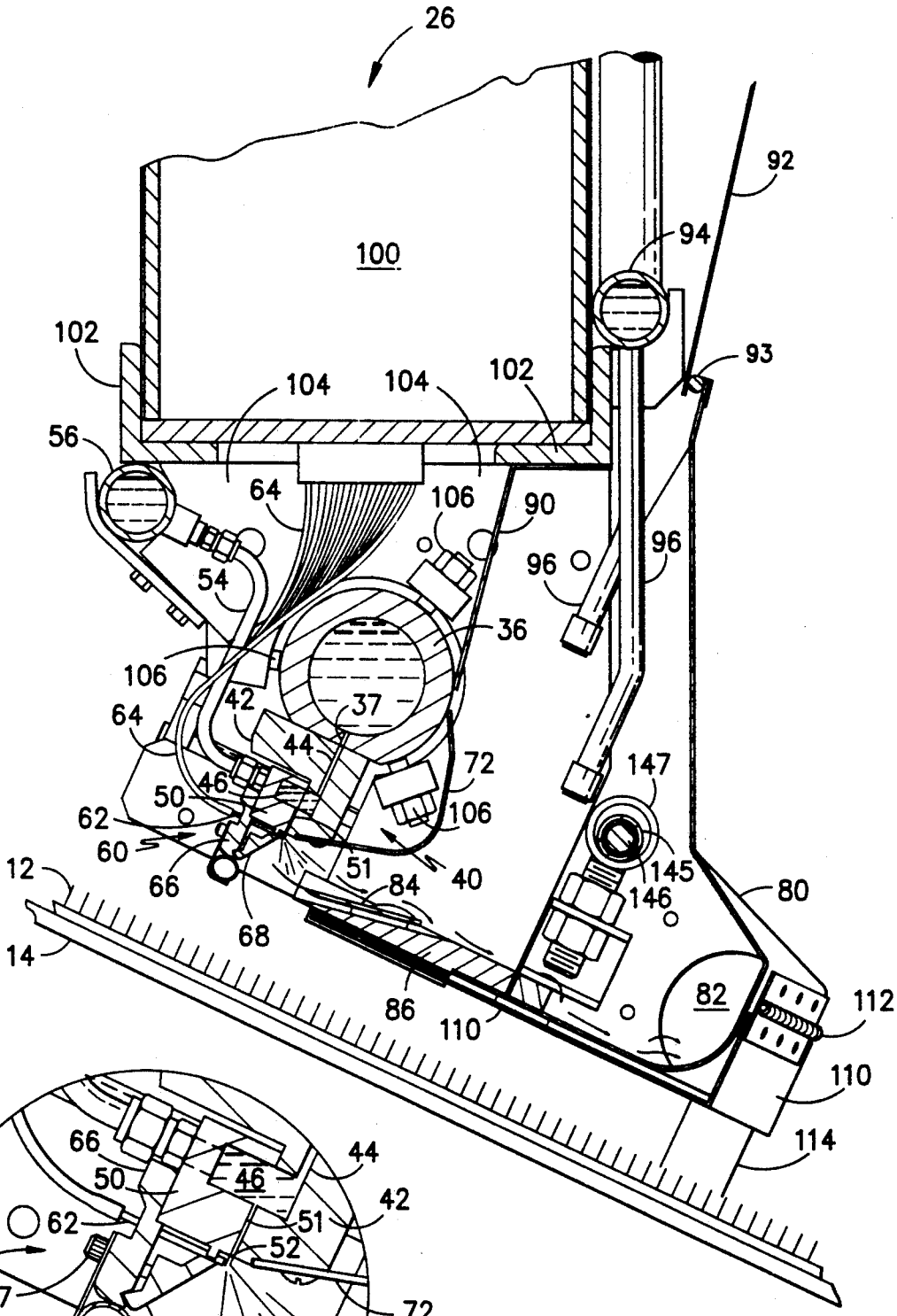
FIG. 5 is a diagram similar to FIG. 4, but instead the right most array of FIG. 3, showing the liquid dye stream being deflected.
Figure 5A:
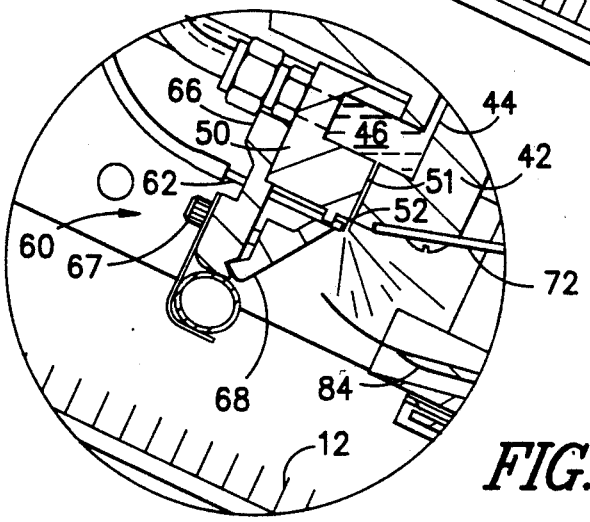
FIG. 5A is an enlarged view of a portion of the apparatus shown in FIG. 5.

As depicted most clearly in FIGS. 4 through 5A, primary dye manifold assembly 36 is comprised of a pipe having a flat mating surface which accommodates a corresponding mating surface on sub-manifold assembly 40. Sub-manifold assembly 40 is comprised of sub-manifold module section 42, grooved dye outlet module 50, and an elongate sub-manifold 46 cooperatively formed by elongate mating channels in sub-manifold section 42 and outlet module 50. Sub-manifold module 42 is attached to primary dye manifold assembly 36 by bolts (not shown) or other suitable means so that drilled outlet conduits 37 in the mating surface of manifold assembly 36 and corresponding drilled passages 44 in the mating surface of sub-manifold module section 42 are aligned, thereby permitting pressurized liquid dye to flow from the interior of manifold assembly 36 to elongate sub-manifold 46.

Associated with the mating face of dye outlet module 50 are a plurality of grooves or channels 51 (shown in FIG. 5A) which, when dye outlet module 50 is mated to sub-manifold module 42 as by bolts or other appropriate means (not shown), form dye passage outlets 52 through which uniform quantities of liquid dye from sub-manifold 46 may be directed onto the substrate in the form of aligned, parallel streams. The relative position or alignment of dye channels 51 with respect to primary dye collector plate 84 and collector plate support member 86 may be adjusted by appropriate rotation of jacking screws 106 associated with mounting brackets 104.

Associated with dye outlet module 50 is dye by-pass manifold 56 and by-pass manifold conduit 54, shown most clearly in FIGS. 4 and 5, which collectively act as a pressure ballast and provide for a uniformly pressurized dye supply within sub-manifold 46.

As shown in FIGS. 4 and 5, primary dye collection chamber 80 is positioned generally opposite the array of air deflection tubes 62, for the purpose of collecting liquid dye which has been diverted from the dye streams by the transverse air stream from tubes 62. Primary dye collection chamber 80 also captures and collects partially diverted water sprayed at high pressure from manifold assembly 36, as well as water sprayed from staggered cleaning water nozzles 96 associated with wash water manifold 94, whenever the array is cleaned, e.g., when use of a different color dye is desired Primary dye collection chamber 80 may be attached by conventional means to mounting brackets 104 as well as to sharpened collector plate support member 86, which may be rabbeted to accommodate the floor of chamber 80, as shown, and forms a cavity into which dye or wash water may be collected and removed from the interior of the array via primary dye collection conduit 82. Mist shield 90, which generally extends the length of the array, is attached to the bottom of the valve box 100 using bolts or other suitable means, not shown Shield 90, extending from valve box 100 to manifold assembly 36, prevents wash water or dye, either in the form of droplets or airborne mist, from traveling between manifold assembly 36 and the valve box 100 and dripping onto and staining the substrate from that side of the array. Exterior mist shield 92, also attached to valve box 100, uses spring force to compress elastomeric seal 93 which is attached to the dye collection chamber 80. Shield 92 and seal 93 prevent wash water, primarily in the form of airborne mist, from exiting the top of the dye collection chamber 80 and settling onto the substrate below. Both shields 90 and 92 and dye collection chamber 80 are preferably open at both ends so as to allow the pressurized air from air deflection tubes 62 to escape without undue restriction.

Also associated with dye outlet module 50 is deflecting air jet assembly 60 (shown most clearly in FIG. 5A), by which individual streams of air from air tubes 62 may be selectively directed, via an array of valves in valve box 100 and connecting supply conduits 64, across the path of respective dye streams eminating from outlets 52. Assembly 60 is comprised of air supply tube support plate 66 and air tube clamp 68, intended to align and secure individual air deflecting tubes 62 immediately outside dye outlets 52 (FIG. 5A). By rotating air tube clamp screw 67, the pressure exerted by clamp 68 on air tubes 62 may be adjusted Airfoil 72, positioned generally opposite air tubes 62, is intended to reduce the degree of turbulence within the region of the array due to the action of the transverse air streams issuing from tubes 62. Although not shown, the protruding portion of dye outlet module 50 against which air tube clamp 68 urges tubes 62 is preferably configured with a series of uniformly spaced vee-shaped notches into which tubes 62 may partially be recessed to assist in aligning tubes 62 with dye outlets 52. Further details of a similar alignment arrangement may be found in commonly assigned U.S. Pat. No. 4,309,881.

When the liquid dye stream is deflected, the liquid dye exiting from dye passage outlets 52 is directed into primary dye collector chamber 80, which may be formed of suitable sheet material such as stainless steel and extends along the length of the array 26. Associated with collection chamber 80 is a primary dye collector plate 84 which is comprised of a thin flexible blade-like member which is positioned parallel and closely adjacent to dye passage outlets 52. Primary collector plate 84 may be adjustably attached at spaced locations along its length, as by bolt and spacer means 85, to wedge-shaped elongate collector plate support member 86, which forms an extension of the floor of primary collection chamber 80 and which is sharpened along the edge nearest the outlets 52 of dye discharge channels 51 and extends along the length of array 26. Any suitable adjustment means by which a thin, blade-like collector plate 84 may be mounted under tension along its length and aligned with the axes of dye outlet module grooves 51 may be employed; one such means is disclosed in commonly assigned U.S. Pat. No. 4,202,189.

In a typical dyeing operation utilizing such apparatus, so long as no pattern information is supplied by control device 20 to the air valves V associated with the array of dye outlets 52, the valves remain "open" to permit passage of pressurized air from air manifold 74 through air supply conduits 64, which continuously deflects all of the continuously flowing dye streams from the array outlets 52 into the primary collection chamber 80 for recirculation. When the substrate 12 initially passes beneath the dye outlets 52 of the individual arrays 26, pattern control system 20 is actuated in a suitable manner, such as manually by an operator Thereafter, signals from transducer 18 prompt pattern information to be processed and sent from pattern control system 20. As dictated by the pattern information, pattern control system 20 generates control signals to selectively "close" appropriate air valves so that, in accordance with the desired pattern, deflecting air streams at specified individual dye outlets 52 along the arrays 26 are interrupted and the corresponding dye streams are not deflected, but instead are allowed to continue along their normal discharge paths to strike the substrate 12. Thus, by operating the air valves of each array in the desired pattern sequence, a pattern of dye may be placed on the substrate during its passage under the respective array.

For the sake of discussion, the following assumptions, conventions, and definitions are used herein. The term "dye jet" or "jet" refers to the applicator apparatus individually associated with the formation of each dye stream in the various arrays. It will be assumed that the substrate will be printed with a pattern having a resolution or print gauge of one-tenth inch as measured along the path under the arrays, i.e., the arrays will direct (or interrupt the flow of) dye onto the substrate in accordance with instructions given each time the substrate moves one-tenth inch along its path. This implies that a pattern line,.as defined earlier (i.e., a continuous line of single pattern elements extending across the substrate), has a width or thickness of one-tenth inch. Substrate speed along the conveyor will be assumed to be one linear inch per second, or five linear feet per minute. This implies that, during each time period in which the substrate moves one-tenth inch (i.e., each one-tenth second), which hereinafter may be referred to as a pattern cycle, each and every valve controlling the individual dye jets in the various arrays will receive an electronically encoded instruction which specifies (a) whether the valve should interrupt the flow of diverting air intersecting its respective dye jet and, if so, (b) the duration of such interruption. This time, during which the stream of dye is undeflected and contacts the substrate, may be referred to as "firing time" or the time during which a dye jet "fires" or is actuated. Firing time and dye contact time are synonymous. Array sequence numbering, i.e., first, second, etc., refers to the order in which the substrate passes under or opposite the respective arrays. Similarly, "downstream" and "upstream" refer to the conveyor direction and opposite that direction, respectively. A total of eight arrays are assumed, each having four hundred eighty individual dye jets, although the invention is by no means limited to such numbers and may easily be adapted to support thousands of individual dye jets per array, and/or a greater number of individual arrays. Array-to-array spacing along the direction of substrate travel is assumed to be uniformly ten inches, i.e., one hundred pattern line widths. Note that one hundred pattern lines implies the processing of pattern data for one hundred pattern cycles.

For purposes of comparison, a control system of the prior art is disclosed in FIG. 6 and will be described in detail below. For purposes of explanation, the format of the patterning data or patterning instructions for this prior art control system, as indicated in FIG. 6, is schematically depicted in FIG. 7. As shown, the pattern element data (in Data Format A1) is first converted to "on/off" firing instructions (referring to the deactuation or actuation, respectively, of the diverting air associated with the individual dye streams) by electronically associating the "raw" pattern data with pre-generated firing instruction data from a computer generated look-up table. This firing instruction data merely specifies, using a single logical bit for each jet, which jets in a given array shall fire during a given pattern cycle, and is represented by Data Format A2 of FIG. 7.

Following this operation, the sequence of "on/off" firing instructions is then rearranged to accommodate the physical spacing between the arrays. This is necessary to assure that the proper firing instruction data corresponding to a given area of the substrate to be patterned arrives at the initial array and at each downstream array at the exact time at which that given substrate area passes under the proper array. This is accomplished by interleaving the array data and inserting synthetic "off" data for downstream arrays at pattern start and for upstream arrays at pattern end, to effectively sequence and delay the arrival of pattern data to the downstream arrays until the substrate has had the opportunity to move into position under the downstream arrays. The data exiting this interleaving operation is in the form of a serial bit stream comprising, for a given pattern cycle, one bit per jet (indicating whether the jet should fire during this cycle) for each respective jet in each array, as indicated in Data Format A3 of FIG. 7.

This serial bit stream is then fed to a data distributor which, for each "start pattern cycle" pulse received from the registration control system (indicating a new pattern line is to begin), simply counts the proper number of bits corresponding to the number of jets in a given array, in the sequence such bits are received from the interleaving operation. When the proper number of bits necessary to comprise firing instructions for that entire array has been counted, that set of bits is sent, in serial form, to the proper array for further processing, as described below, and the counting procedure is begun again for the next array involved in the patterning operation. Each array, in a rotating sequence, is sent data in similar fashion for a given pattern line, and the process is repeated at each "start patterning/cycle" pulse until the patterning of the substrate is completed.

Associated with each array is an electronically encoded value for the actual firing time to be used by that array for all patterning cycles associated with a given pattern. It is important to note that, while this "duration" value may vary from array to array, for a given array it is constrained to be uniform, and cannot vary from jet to jet or from patterning cycle to patterning cycle. Therefore, if any jets in a given array must fire during a given patterning cycle, all such firing jets must fire for the same period of time. This "duration" value is superimposed upon the "fire/don't fire" single-bit data received from the pattern data distribution operation and is temporarily stored in one or more shift registers individually associated with each array. After a predetermined delay to allow time for the shift registers to fill, the data is sent simultaneously to the respective valves associated with the diverting streams of air at each dye jet position along the array.

The control system of the present invention, as depicted in FIGS. 8 through 11, may be most easily described by considering the system as essentially comprising three separate data storage and allocation systems (a firing time converter, which incorporates a memory, a "stagger" memory, and a "gatling" memory) operating in a serial sequence. These systems are schematically depicted in FIG. 8, which represents an overview of the control system of the present invention as applied to a patterning device disclosed above. FIG. 11 schematically depicts representative data formats at the process stages indicated in FIG. 8. Each array is associated with a respective firing time converter and "stagger" memory, followed by a separate "gatling" memory, arranged in tandem. Each of these major elements will be discussed in turn.

As shown in FIG. 8, the raw pattern data is sent as prompted by the "start pattern cycle" pulse received from the substrate motion sensor. This sensor merely generates a pulse each time the substrate conveyor moves the substrate a predetermined linear distance (e.g., one-tenth inch) along the path under the patterning arrays. (Note that, in the system of the prior art, the "start pattern cycle" pulse was received from the registration control system; in the novel system described herein, a separate registration control system is not needed.) The same "start pattern cycle" pulse is simultaneously sent to each array, for reasons which will be explained below.

The raw patterning data is in the form of a sequence of pixel codes, with one such code specifying, for each pattern line, the dye jet response for a given dye jet position on each and every array, i.e., each pixel code controls the response of eight separate dye jets (one per array) with respect to a single pattern line. As discussed above, the pixel codes merely define those distinct areas of the pattern which may be assigned a different color. The data is preferably arranged in strict sequence, with data for applicators 1–480 for the first pattern line being first in the series, followed by data for applicators 1–480 for the second pattern line, etc., as depicted by Data Format B1 of FIG. 11. The complete serial stream of such pixel codes is sent, in identical form and without any array-specific allocation, to a firing time converter/memory associated with each respective array for conversion of the pixel codes into firing times This stream of pixel codes preferably comprises a sufficient number of codes to provide an individual code for each dye jet position across the substrate for each pattern line in the overall pattern. Assuming eight arrays of 480 applicators each, a pattern line of 0.1 inch in width (measured along the substrate path), and an overall pattern which is 60 inches in length (i.e., measured along the substrate path), this would require a raw pattern data stream comprised of 288,000 separate codes Comprising each firing time converter is a look-up table having a sufficient number of addresses so that each possible address code forming the serial stream of pattern data may be assigned a unique address in the look-up table At each address within the look-up table is a byte representing a relative firing time or dye contact time, which, assuming an eight bit address code is used to form the raw pattern data, can be zero or one of 255 different discrete time values corresponding to the relative amount of time the dye jet in question is to remain "on." (More accurately, in the patterning apparatus disclosed, these time values represent the relative amount of time the valve associated with the respective diverting air jet shall remain closed, thereby interrupting the diverting air stream and allowing the stream of dye to strike the substrate.) Accordingly, for each eight bit byte of pixel data, one of 256 different firing times (including a firing time of zero) is defined for each specific jet location one each and every array. Jet identity is determined by the relative position of the address code within the serial stream of pattern data and by the information pre-loaded into the look-up table, which information specifies in which arrays a given jet position fires, and for what length of time. (If desirable, data individually comprised of two or more bytes, specifying, e.g., one of 65,536 different firing times or other patterning parameter levels may be used in accordance with the teachings herein, with appropriate modifications to the hardware.) The result is sent, in Data Format B2 (see FIG. 11), to the "stagger" memory associated with the given array. At this point, no attempt has been made to compensate for the physical spacing between arrays or to group and hold the data for sending to the actual air valves associated with each dye jet.

Compensation for the physical spacing between arrays may be best explained with reference to FIGS. 9A and 9B, which functionally describe the individual stagger memories for various arrays in greater detail.

The "stagger" memory operates on the firing time data produced by the look-up tables and performs two principal functions: (1) the serial data stream from the look-up table, representing firing times, is grouped and allocated to the appropriate arrays on the patterning machine and (2) "non-operative" data is added to the respective pattern data for each array to inhibit, at start-up and for a pre-determined interval which is specific to that particular array, the reading of the pattern data in order to compensate for the elapsed time during which the specific portion of the substrate to be patterned with that pattern data is moving from array to array.

The "stagger" memory operates as follows. The firing time data is sent to an individual random access memory (RAM) associated with each of the eight arrays. Although either static or dynamic RAM's may be used, static RAM's have been found to be preferred because of increased speed. At each array, the data is written to the RAM in the order in which it was sent from the look-up table, thereby preserving the jet and array identity of the individual firing times. Each RAM preferably has sufficient capacity to hold firing time information for the total number of pattern lines extending from the first to the eighth array (assumed to be seven hundred for purposes of discussion) for each jet in its respective array. In the discussion which follows, it may be helpful to consider the seven hundred pattern lines as being arranged in seven groups of one hundred pattern lines each (to correspond with the assumed inter-array spacing).

The RAM's are both written to and read from in a unidirectional repeating cycle, with all "read" pointers being collectively initialized and "lock-stepped" so that corresponding address locations in all RAM's for all arrays are read simultaneously. Associated with each RAM is a predetermined offset value which represents the number of sequential memory address values separating the "write" pointer used to insert the data into the memory addresses and the "read" pointer used to read the data from the RAM addresses, thereby "staggering" in time the respective read and write operations for a given memory address.

As depicted on the left hand side of FIG. 9A, the RAM offset value for the first array is zero, i.e., the "read pattern data" operation is initiated at the same memory address as the "write pattern data" operation, with no offset. The offset for the second array, however, is shown as being one hundred, which number is equal to the number of pattern lines or pattern cycles (as well as the corresponding number of read or write cycles) needed to span the distance physically separating the first array from the second array, as measured along the path of the substrate in units of pattern lines. As depicted, the "read pattern" pointer, initialized at the first memory address location, is found one hundred address locations "above" or "earlier" than the "write" pointer. Accordingly, beginning the "read" operation at a memory address location which lags the "write" operation by one hundred consecutive locations effectively delays the reading of the written data by one hundred pattern cycles to correspond to—and compensate for—the physical spacing between the first and second array. To avoid using "dummy" data for the "read" operation until the "read" pointer catches up with the first address written to by the "write" pointer, a "read inhibit" procedure may be used. Such procedure would only be necessary at the beginning and end of a pattern. Alternatively, data representing zero firing time can be loaded in the RAM's in the appropriate address locations so that the "read" operation, although enabled, reads data which disables the jets during such times.

The right hand side of FIG. 9A depicts the stagger memory for the eighth array. As with all other arrays, the "read" pointer has been initialized to the first memory address in the RAM. The "write" pointer, shown at its initialized memory address location, leads the "read" pointer by an address difference equivalent to seven hundred pattern lines (assuming seven intervening arrays and a uniform inter-array spacing of one hundred pattern lines).

FIG. 9B depicts the stagger memories of FIG. 9A exactly one hundred pattern cycles later, i.e., after the data for one hundred pattern lines have been read. The "read" and "write" pointers associated with Array 1 are still together, but have moved "down" one hundred memory address locations and are now reading and writing the firing time data associated with the first line of the second group of one hundred pattern lines in the RAM.

The "read" and "write" pointers associated with Array 2 are still separated by an offset corresponding to the physical spacing between Array 1 and Array 2, as measured in units of pattern lines. Looking at the pointers associated with Array 8, the "read" pointer is positioned to read the first line of firing time data from the second group of one hundred pattern lines, while the "write" pointer is positioned to write new firing time data into RAM addresses which will be read only after the existing seven hundred pattern lines in the RAM are read. It is therefore apparent the "read" pointer is specifying firing time data which was written seven hundred pattern cycles previously.

The storage registers associated with each array's stagger memory store the firing time data for the pattern line to be dyed by that respective array in that pattern cycle until prompted by a pulse from the substrate transducer indicating the substrate has traveled a distance equal to the width of one pattern line. At that time, the firing time data, in Data Format B3 (see FIG. 11), is sent to the "gatling" memory for processing as indicated below, and firing time data for the next pattern line is forwarded to the stagger memory for processing as described above.

FIG. 10 depicts a "gatling" memory module for one array. For the patterning device depicted in FIG. 1, eight configurations of the type shown in FIG. 10 would be necessary, one for each array. In a preferred embodiment, all would be driven by a common clock and counter. The gatling memory performs two principal functions: (1) the serial stream of encoded firing times is converted to individual strings of logical (i.e., "on" or "off") firing commands, the length of each respective "on" string reflecting the value of the corresponding encoded firing time, and (2) these commands are quickly and efficiently allocated to the appropriate applicators.

As depicted in FIG. 10, associated with each array is a set of dedicated first in-first out memory modules (each of which will be hereinafter referred to as a "FIFO"). An essential characteristic of the FIFO is that data is read out of the FIFO in precisely the same order or sequence in which the data was written into the FIFO. In the exemplary embodiment described herein, the set of FIFO modules must have a collective capacity sufficient to store one byte (i.e., eight bits, equal to the size of the address codes comprising the original pattern data) of data for each of the four hundred eighty diverting air valves in the array. For purposes of explanation., it will be assumed that each of the two FIFO's shown can accommodate two hundred forty bytes of data.

Each FIFO has its input connected to the sequential loader and its output connected to an individual comparator. A counter is configured to send an eight bit incrementing count to each of the comparators in response to a pulse from a "gatling" clock. The "gatling" clock is also connected to each FIFO, and can thus synchronize the initiation of operations involving both the FIFO's and the respective comparators associated with each FIFO. If the smallest increment of time on which "firing time" is based is to be different from array to array, independent clocks and counters may be associated with each such array. Preferably, the output from each comparator may be operably connected to a respective shift register/latch combination, which serves to store temporarily the comparator output data before it is sent to the respective array, as described in more detail below. Each comparator output is also directed to a common detector, the function of which shall be discussed below. As indicated in FIG. 10, a reset pulse from the detector is sent to both the "gatling" clock and the counter at the conclusion of each pattern cycle, as will be explained below.

In response to the transducer pulse, the respective stagger memories for each array are read in sequence and the data is fed to an array-specific sequential loader, as depicted in FIG. 10. The sequential loader sends the first group of two hundred forty bytes of data received to a first FIFO and the second group of two hundred forty bytes of data to a second FIFO. Similar operations are performed simultaneously at other sequential loaders associated with other arrays. Each byte represents a relative firing time or dye contact time (or, more accurately, an elapsed diverting air stream interruption time) for an individual jet in the array. After each of the FIFO's for each array are loaded, they are simultaneously sent a series of pulses from the "gatling" clock, each pulse prompting each FIFO to send a byte of data (comprised of eight bits), in the same sequence in which the bytes were sent to the FIFO by the sequential loader, to its respective individual comparator. This FIFO "firing time" data byte is one of two separate inputs received by the comparator, the second input being a byte sent from a single counter common to all FIFOs associated with every array. This common counter byte is sent in response to the same gatling clock pulse which prompted the FIFO data, and serves as a clock for measuring elapsed time from the onset of the dye stream striking the substrate for this pattern cycle. At each pulse from the gatling clock, a new byte of data is released from each FIFO and sent to its respective comparator.

At each comparator, the eight bit "elapsed time" counter value is compared with the value of the eight bit "firing time" byte sent by the FIFO. The result of this comparison is a single "fire/no fire command" bit sent to the shift register as well as the detector. If the FIFO value is greater than the counter value, indicating the desired firing time as specified by the pattern data is greater than the elapsed firing time as specified by the counter, the comparator output bit is a logical "one" (interpreted by the array applicators as a "fire" command) Otherwise, the comparator output bit is a logical "zero" (interpreted by the array applicators as a "no fire" or "cease fire" command) At the next gatling clock pulse, the next byte of firing time data in each FIFO (corresponding to the next individual jet along the array) is sent to the respective comparator, where it is compared with the same counter value. Each comparator compares the value of the firing time data forwarded by its respective FIFO to the value of the counter and generates a "fire/no fire" command in the form of a logical one or logical zero, as appropriate, for transmission to the shift register and the detector.

This process is repeated until all two hundred forty "firing time" bytes have been read from the FIFO's and have been compared with the "elapsed firing time" value indicated by the counter. At this time the shift register, which now contains a serial string of two hundred forty logical ones and zeros corresponding to individual firing commands, forwards these firing commands in parallel format to a latch. The latch serves to transfer, in parallel, the firing commands from the shift register to the individual air valves associated with the array dye applicators at the same time the shift register accepts a fresh set of two hundred forty firing commands for subsequent forwarding to the latch. Each time the shift register forwards its contents to the latch (in response to a clock pulse), the counter value is incremented. Following this transfer, the counter value is incremented by one time unit and the process is repeated, with all two hundred forty bytes of "firing time" data in each FIFO being reexamined and transformed into two hundred forty single bit "fire/no fire" commands, in sequence, by the comparator using the newly incremented value of "elapsed time" supplied by the counter. While, in a preferred embodiment, the serial firing commands may be converted to, and stored in, a parallel format by the shift register/latch combination disclosed herein, it is foreseen that various alternative techniques for directing the serial stream of firing commands to the appropriate applicators may be employed, perhaps without converting said commands to a true parallel format.

The above process, involving the sequential comparison of each FIFO's entire capacity of firing time data with each incremented "elapsed time" value generated by the counter, is repeated until the detector determines that all comparator outputs for that array are a logical "zero." This indicates that, for all jets in the array, no desired firing time (represented by the FIFO values) for any jet in the array exceeds the elapsed time then indicated by the counter. When this condition is sensed by the comparator, it indicates that, for that pattern line and that array, all required patterning has occurred. Accordingly, the detector sends "reset" pulses to both the counter and to the gatling clock. The gatling module then waits for the next substrate transducer pulse to prompt the transmission and loading of firing time data for the next pattern line by the sequential loader into the FIFO's, and the reiterative reading/comparing process is repeated as described above.

In a preferred embodiment, the gatling memory for each array may actually consist of two separate and identical FIFO's which may alternately be connected to the array valves. In this way, while data are being read out and compared in one gatling memory, the data for the next pattern line may be loaded into the FIFO's associated with the alternate gatling memory, thereby eliminating any data loading delays which might otherwise be present if only one gatling memory per array were used. It should be apparent that the number of individual FIFO's may be appropriately modified to accommodate a greater or lesser number of dye jets in an array.

FIG. 12 depicts an optional memory, to be associated with each array, which may be used when maximum pattern definition is desired This memory, which may take the form of a static RAM, functions in a "tuning" or "trimming" capacity to compensate, in precise fashion, for small variations in the response time or dye flow characteristics of the individual applicators. This is achieved by means of a look-up table embodied in the RAM which associates, for each applicator in a given array, and, if desired, for each possible firing time associated with each such applicator, an individual factor which increases or decreases the firing time dictated by the pattern data by an amount necessary to cause all applicators in a given array to deliver substantially the same quantity of dye onto the substrate in response to the same pattern data firing instructions.

I claim:

1. A method for transforming a succession of parameter values used to control the selective application of dyes or other marking materials to a moving substrate, each such value being digitally encoded in an individual binary character string of uniform length, into a number of respective binary character sequences, each such sequence being comprised of an individual series of n binary characters having a uniform binary state and wherein n is an integer and the value of n is determined by an individual parameter value corresponding to said respective sequence, wherein said respective binary character sequences are collectively generated by (a) initializing a counter value, (b) successively comparing the encoded parameter value expressed in each of said binary character strings with said counter value, the result of said comparison being a single binary character having a uniform binary state so long as said encoded parameter value is greater than said counter value, and an opposite binary state of said uniform binary state otherwise, (c) incrementing said counter value, and repeating steps (b) and (c), using said incremented counter values, until said incremented counter value exceeds the parameter value encoded in each of said binary character strings these binary character strings represent firing times for dye contact and the value in the counter represents an elapsed firing time with the generated binary character sequence utilized as firing commands to activate individual air valves associated with individual dye applicators.

* * * * *